US005899771A

United States Patent [19]

Clark et al.

[11] Patent Number: 5,899,771

[45] Date of Patent: May 4, 1999

[54] DEVICE FOR FIXING AN ELECTRICAL CONNECTOR TO A PRINTED CIRCUIT BOARD

[75] Inventors: Stephen L. Clark, Dillsburg; David C. Horchler, Millersburg, both of Pa.

[73] Assignee: Berg Technology, Inc., Reno, Nev.

[21] Appl. No.: 08/925,580

[22] Filed: Sep. 8, 1997

Related U.S. Application Data

[62] Division of application No. 08/624,267, Mar. 29, 1996, Pat. No. 5,664,965.

[51] Int. Cl.[6] ..... H01R 13/60

[52] U.S. Cl. ..... 439/567

[58] Field of Search ..... 439/567, 572, 439/571

[56] References Cited

U.S. PATENT DOCUMENTS

| | | | |
|---|---|---|---|
| 1,845,991 | 2/1932 | Walters | 24/295 |
| 2,764,751 | 9/1956 | Gnadke | 340/225 |
| 3,717,066 | 2/1973 | Maurer | 85/5 R |
| 4,142,810 | 3/1979 | Lesaint | 403/252 |
| 4,274,691 | 6/1981 | Abernethy et al. | 439/507 |
| 4,435,031 | 3/1984 | Black et al. | 439/82 |
| 4,668,040 | 5/1987 | Matsuzaki et al. | 439/571 |
| 4,681,389 | 7/1987 | Nakazawa et al. | 439/557 |
| 4,728,295 | 3/1988 | Henrici et al. | 439/84 |
| 4,787,795 | 11/1988 | Kraus | 411/510 |
| 4,824,398 | 4/1989 | Taylor | 439/557 |
| 4,842,552 | 6/1989 | Frantz | 439/557 |
| 4,907,987 | 3/1990 | Douty et al. | 439/571 |
| 4,943,244 | 7/1990 | Teck et al. | 439/567 |
| 4,973,212 | 11/1990 | Jacobs | 411/508 |
| 5,024,607 | 6/1991 | Kachlic | 439/567 |
| 5,044,988 | 9/1991 | Hirayama | 439/571 |
| 5,074,807 | 12/1991 | Parmer | 439/553 |
| 5,085,589 | 2/1992 | Kan | 439/92 |
| 5,104,339 | 4/1992 | Verhoeven | 439/567 |
| 5,115,375 | 5/1992 | Garay | 361/400 |
| 5,145,407 | 9/1992 | Obata et al. | 439/567 |
| 5,171,165 | 12/1992 | Hwang | 439/567 |
| 5,184,963 | 2/1993 | Ishikawa | 439/79 |
| 5,228,870 | 7/1993 | Gorenc et al. | 439/567 |
| 5,238,427 | 8/1993 | Fry et al. | 439/557 |
| 5,241,451 | 8/1993 | Walburn et al. | 361/785 |
| 5,244,413 | 9/1993 | Clark | 439/567 |
| 5,257,948 | 11/1993 | Peterson | 439/571 |
| 5,316,500 | 5/1994 | Vanaleck et al. | 439/567 |
| 5,334,049 | 8/1994 | Kachlic et al. | 439/567 |
| 5,336,111 | 8/1994 | Thrush et al. | 439/567 |

*Primary Examiner*—Neil Abrams
*Assistant Examiner*—T C Patel
*Attorney, Agent, or Firm*—Daniel J. Long; M. Richard Page

[57] ABSTRACT

Disclosed is an assembly which comprises a printed circuit board on which there is mounted a component of an electrical connector. The printed circuit board and the electrical connector component have aligned mounting apertures. A boardlock member extends axially through these apertures and has a mounting foot engagement structure from which two resilient spaced legs depend. These spaced legs each have projections which are axially spaced from one another so that the connector member may engage a circuit board of one thickness on the projection of one leg and also engage a circuit board of another thickness by the projection on the other leg.

1 Claim, 5 Drawing Sheets

DEVICE FOR FIXING AN ELECTRICAL CONNECTOR TO A PRINTED CIRCUIT BOARD

This application is a division of application Ser. No. 08/624,267, filed Mar. 29, 1996, now U.S. Pat. No. 5,664,965.

BACKGROUND OF THE INVENTION 1. i. Field of the Invention

The present invention relates to electrical connectors and more particularly to means for fixing electrical connectors to printed circuit boards.

2. Brief Description of Prior Developments

Various means have been disclosed in the prior art for fixing electrical connectors on a PCB. U.S. Pat. No. 5,336,111, for example, discloses a boardlock device which fits into a pair of generally aligned apertures in the connector and the circuit board. On the lower board engagement section, legs diverge outwardly to a pair of vertexes and when the boardlock is fully inserted into the apertures the vertexes will be positioned beneath the circuit board so as to hold it in engagement with the connector.

A disadvantage to such means of fixing a connector to a circuit board is that a number of different boardlocks will be required so that connectors may be suitably fixed to any of the conventional board thicknesses which may be encountered.

A need, therefore, exists for a means for a device which is capable of reliably and economically fixing an electrical connector to a PCB.

SUMMARY OF THE INVENTION

In the assembly of the present invention, a component of an electrical connector having a mounting foot with a mounting aperture is positioned on a PCB which also has a mounting aperture so that the mounting apertures are aligned. A boardlock is axially inserted into the aligned mounting apertures. An upper mounting foot engagement means engages the mounting foot of the electrical connector component. Parallel resilient legs depend from the mounting foot engagement means and are positioned axially in the aligned slots.

A first board engagement means is positioned on one of the depending legs, and a second board engagement means is positioned on the other of the depending legs. The first and second board engagement means are axially displaced from one another. Consequently a PCB of one thickness may be engaged by the first board engagement means while a PCB of another thickness may be engaged by the second board engagement means. A single boardlock may therefore be used on boards of different thicknesses. The need to design and manufacture multiple types of boardlocks for every conventional thickness of PCB and to keep such boardlocks in stock in manufacturing operations is thus avoided.

Also encompassed within the invention is a boardlock for fastening a component of an electrical connector to a PCB which includes a mounting foot engagement means. A first leg depends from the mounting foot engagement means and has a first PCB engagement means adapted to engage a PCB of one thickness. A second leg also depends from the mounting foot engagement means and has a second PCB engagement means adapted to engage a PCB of another thickness.

Finally, a method of fastening a component of an electrical connector to a PCB is also encompassed within the invention. This method comprises the steps of aligning the mounting footer aperture with the PCB aperture; then axially inserting the boardlock into the aligned apertures; and then selectively engaging the PCB with either the first or the second PCB engagement means depending on the thickness of

BRIEF DESCRIPTION OF THE DRAWINGS

The assembly of the present invention is further described with reference to the accompanying drawings in which.

DETAILED DESCRIPTION OF THE PREFERRED EMBODIMENTS

Figure 1:
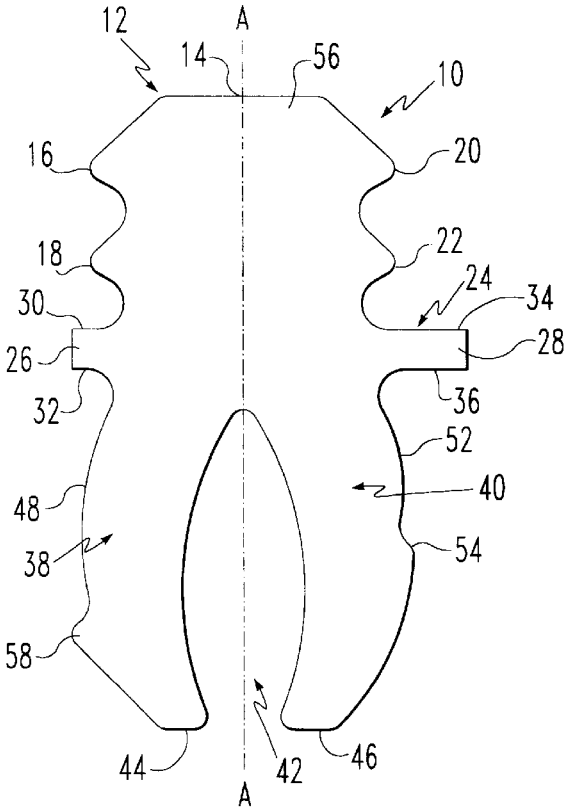
FIG. 1 is a side elevational view of a boardlock used in the assembly of the present invention.
Figure 2:
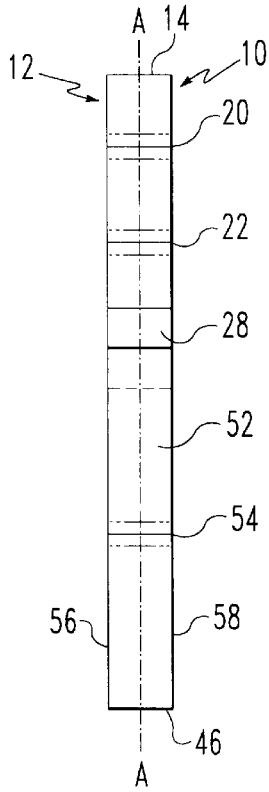
FIG. 2 is an end view of the boardlock shown in FIG. 1.

Referring to FIGS. 1–2, the boardlock used in the assembly of the present invention is shown generally at numeral 10. This boardlock will preferably be comprised of a single metallic body which has at its upper side a mounting foot engagement section shown generally at numeral 12. This mounting foot engagement section will have a top surface 14 and lateral projections 16, 18, 20 and 22 for grasping a slot in the mounting foot as will be explained hereafter. Beneath the mounting foot engagement section there is a beam member shown generally at 24 which extends perpendicularly from the longitudinal axis of the boardlock. This beam member includes a minor lateral side 26 and a major lateral side 28. The minor lateral side has a top edge 30 and a bottom edge 32 and a major lateral side has a top edge 34 and a bottom edge 36. Depending downwardly from the mounting foot engagement section there are opposed resilient legs which are shown generally at numerals 38 and 40. Between these legs there is a medial recess 42 and the legs have respectively bottom edges 44 and 46. Leg 38 has an arcuate edge 48 with a lateral projection 58. Leg 40 has an arcuate edge 52 with a projection 54. The body of the boardlock is also characterized by major opposed planar sides 56 and 58. The longitudinal axis of the boardlock is shown at A—A.

Figure 3:
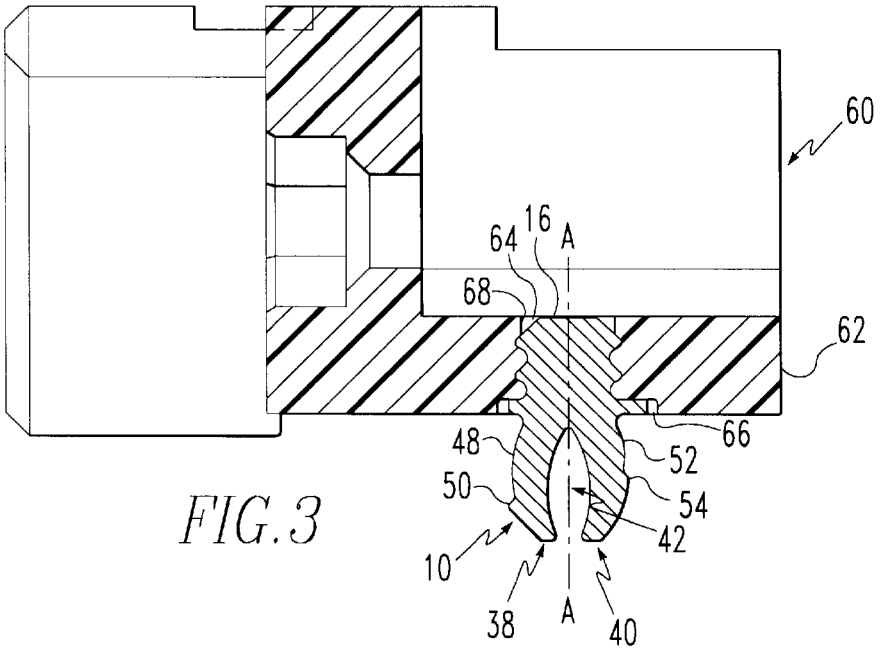
FIG. 3 is a vertical cross sectional view of the boardlock shown in FIG. 1 as engaged with a mounting foot of a connector.
Figure 4:
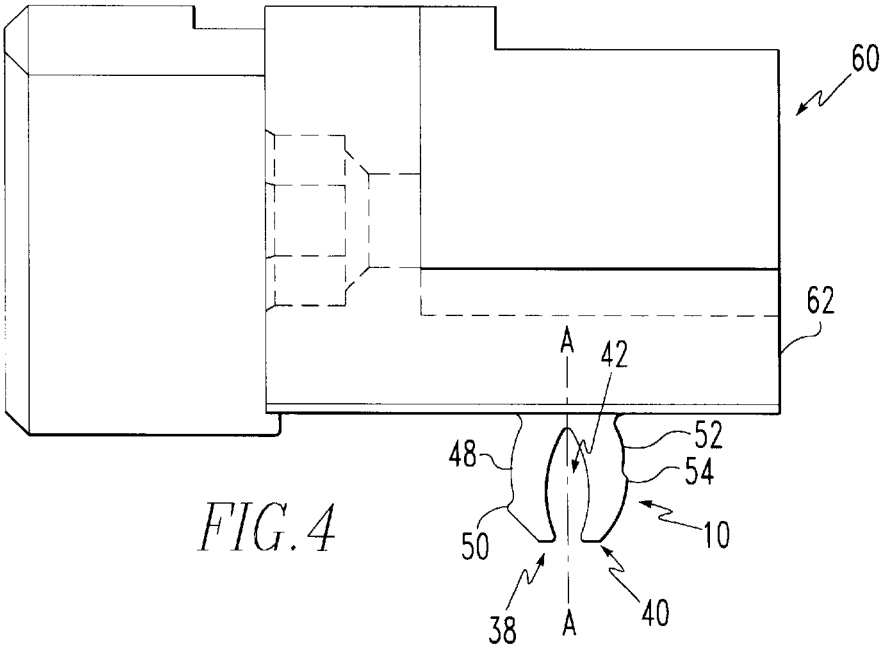
FIG. 4 is a side elevational view of the assembly shown in FIG. 3.
Figure 5:
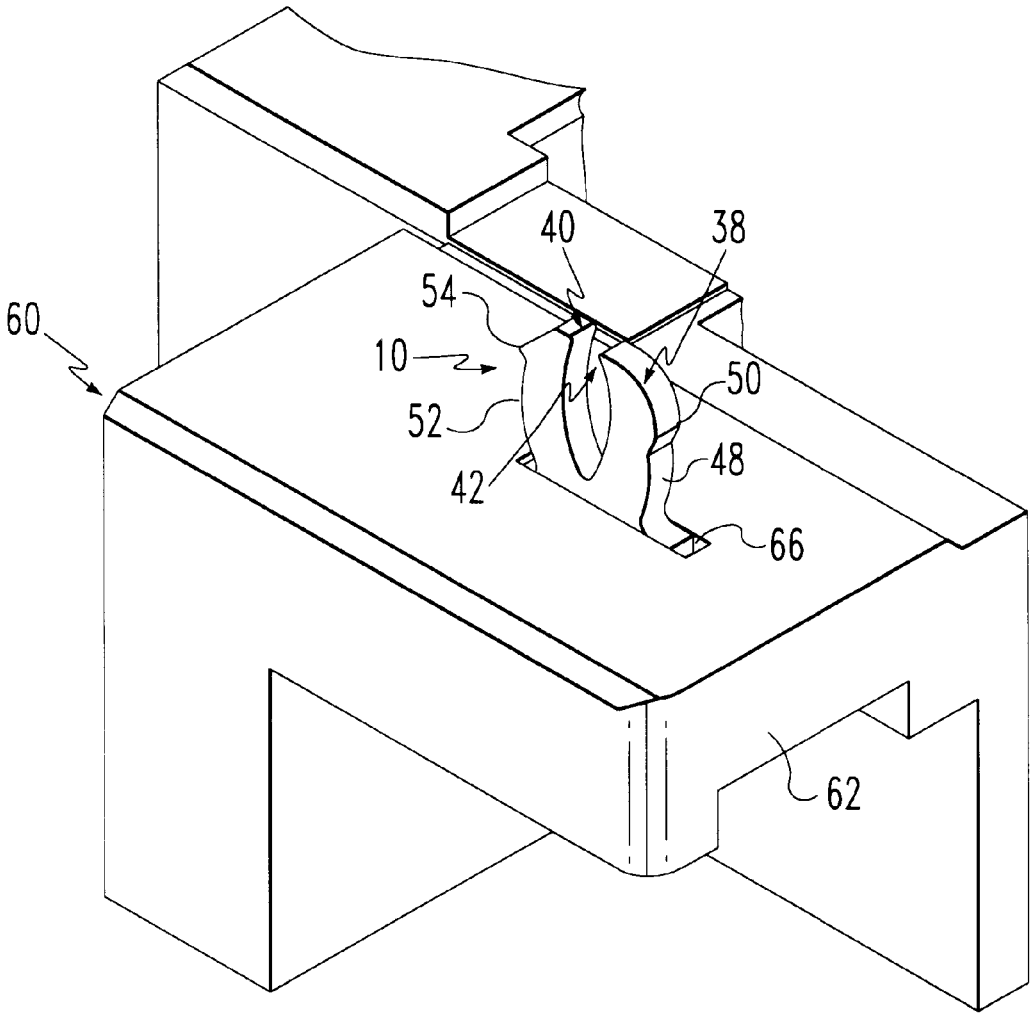
FIG. 5 is a bottom perspective view of the assembly shown in FIG. 4.

Referring to FIGS. 3–5 it will be seen that the boardlock 10 will be used to mount the receptacle shown in fragment at numeral 60. This receptacle has a mounting foot 62 with a slot 64. At the bottom side of the slot there is a widened lower recess 66, and within there are a number of peripheral recesses as at 68 which receive projections as at 16 of the mounting foot engagement section of the boardlock. As a result of the interaction of these projections on the boardlock and the recesses in the mounting foot slot the boardlock is securely fixed to the mounting foot and receptacle. The longitudinal axis of the boardlock and the mounting aperture is shown at A—A in FIGS. 3–4. It will be understood that this axis is similarly positioned in other drawings where it is not specifically shown.

Figure 7:
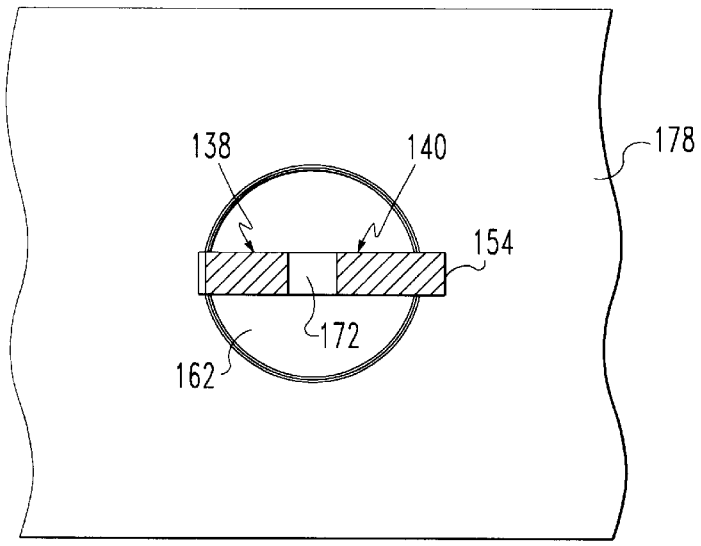
FIG. 7 is a cross section through VII—VII in FIG. 6.
Figure 6:
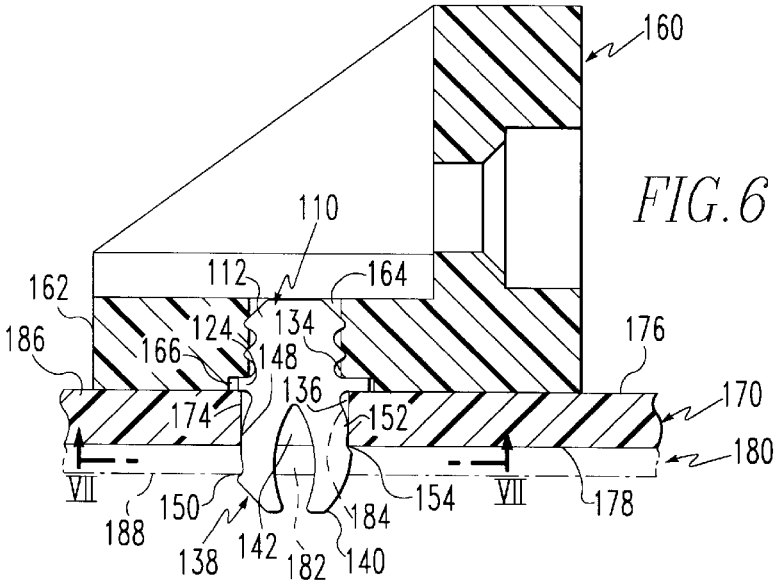
FIG. 6 is a vertical cross sectional view of a preferred embodiment of the entire assembly of the present invention which comprises the assembly shown FIG. 4 as mounted on a PCB.

Referring to FIGS. 6 and 7, a boardlock 110 similar to the boardlock described in FIGS. 1–5 is fixed to a mounting foot 162 of a receptacle 160 by means of the mounting foot engagement section 112. The beam 124 is positioned in a recess 166 in the mounting foot. The mounting foot 162 is superimposed over a PCB shown generally at numeral 170 and the slot 164 in the mounting foot is generally aligned with an aperture 172 in the PCB. The legs 138 and 140 of the boardlock extend into the aperture in the PCB and the arcuate edges of these legs 148 and 152 respectively bear against the inner peripheral surface 174 of this aperture. The PCB has a top surface 176 and a bottom surface 178. The top surface as at 134 of the beam bears against the mounting foot and the bottom surface as at 136 bears against the top surface of the PCB. The projection 154 on the leg 140 bears against the bottom surface 178 of the PCB. From FIG. 6 it will also be seen that a second PCB shown in phantom lines at numeral 180 may be engaged by the same boardlock. That second PCB has a aperture 180 with an inner peripheral surface 184 which is also aligned with the slot 164 in the mounting foot. The PCB 180 also has a top surface 186 on which the mounting foot and the bottom surface of beam 124 rests. The arcuate edges of the legs bear against the inner peripheral surface 184 of aperture 182, and projection 150 on leg 138 bears against the bottom edge 188 of PCB 180 to secure the receptacle 160 in place on that PCB. Those skilled in the art will appreciate that PCB 170 may have, for example, a conventional thickness of 0.062 in and PCB may have a conventional thickness of 0.093 in. It will thus be appreciated that a single boardlock 110 will effectively engage a receptacle to either a 0.062 in. PCB or a 0.093 in. PCB.

Referring to FIGS. 8*a*–9*b*, a second preferred embodiment of the assembly of the present invention is shown. In this embodiment a boardlock 10 also similar to the boardlock described in FIGS. 1–5 is fixed to a mounting foot 262 of a receptacle 260 by means of the mounting foot engagement section (not shown) like the previously described boardlock. The beam (not shown) is positioned in a recess (not shown) in the mounting foot. The mounting foot is superimposed over a PCB shown generally at numeral 270 and the slot 264 in the mounting foot is generally aligned with an aperture 272 in the PCB. The legs 238 and 240 of the boardlock extend into the aperture in the PCB and the arcuate edges of these legs 248 and 252 respectively bear against the inner peripheral surface 274 of this aperture. The PCB has a top surface 276 and a bottom surface 278 as in the other embodiments. The top surface of the beam bears against the mounting foot and the bottom surface bears against the top surface of the PCB. A lead in device 290 extends downwardly adjacent the slot in the mounting foot of the receptacle. This lead in device is comprised of a semi circular element 292 and 294 which are positioned adjacent the planar surfaces 256 and 258 of the legs of the boardlock.

Figure 9A:
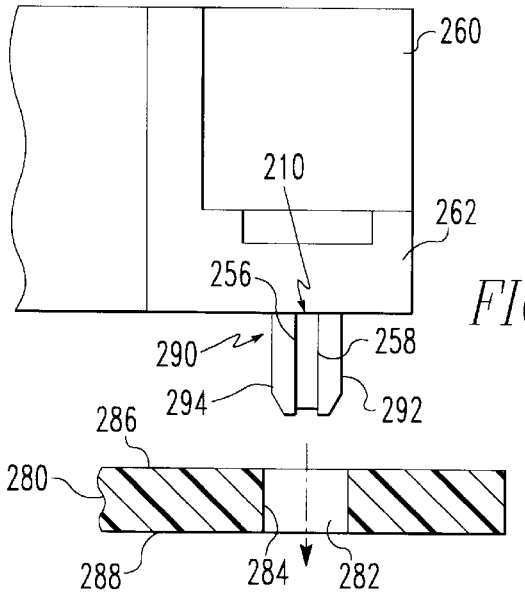
FIG. 9*a* is a front elevational view of the second preferred embodiment shown in FIGS. 8*a*–8*c* in which the receptacle and boardlock are shown prior to engagement with a different PCB.
Figure 9B:
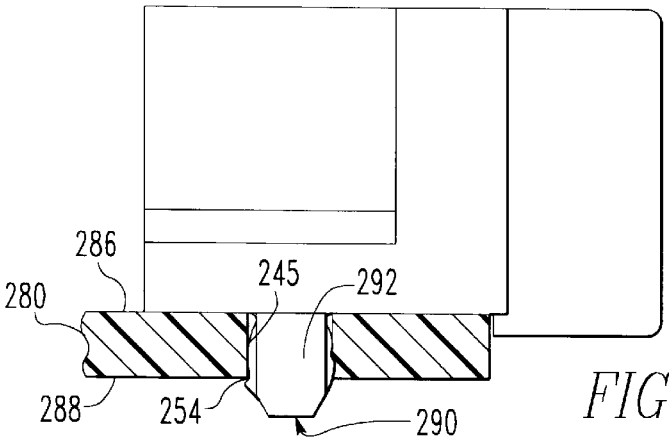
FIG. 9*b* is a side elevational view of the assembly shown in FIG. 9*a* after the receptacle and boardlock have been engaged with the PCB.
Figure 8A:
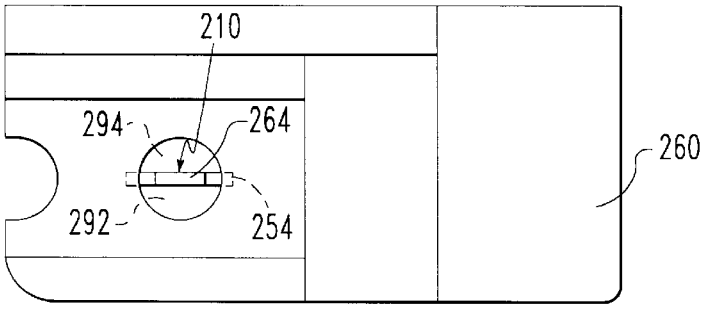
FIG. 8*a* is a top plan view of an alternate preferred embodiment of the assembly of the present invention in which the boardlock is shown engaged with a receptacle before engagement with a printed circuit board.
Figure 8B:
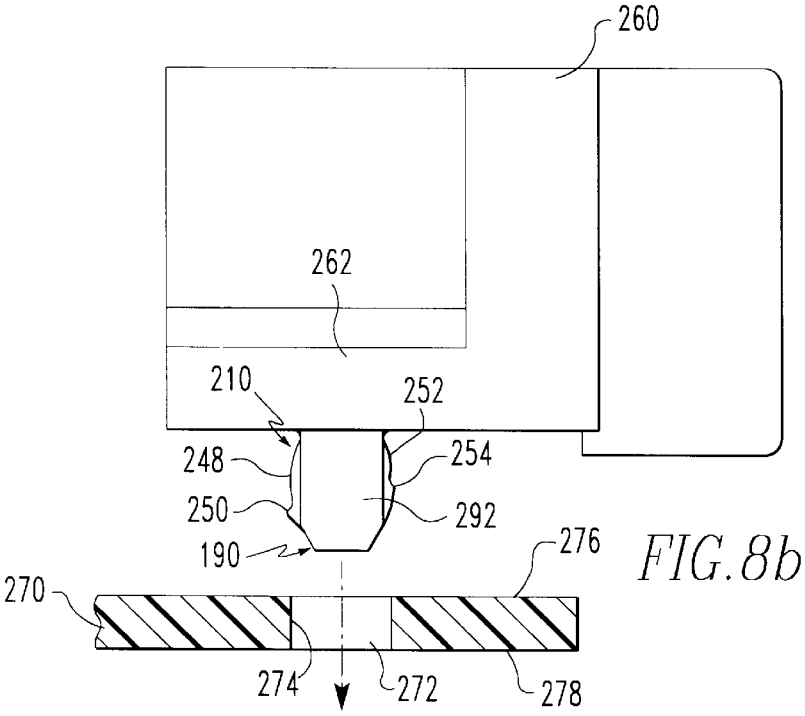
FIG. 8*b* is a side elevational view of the assembly shown in FIG. 8*a;*
Figure 8C:
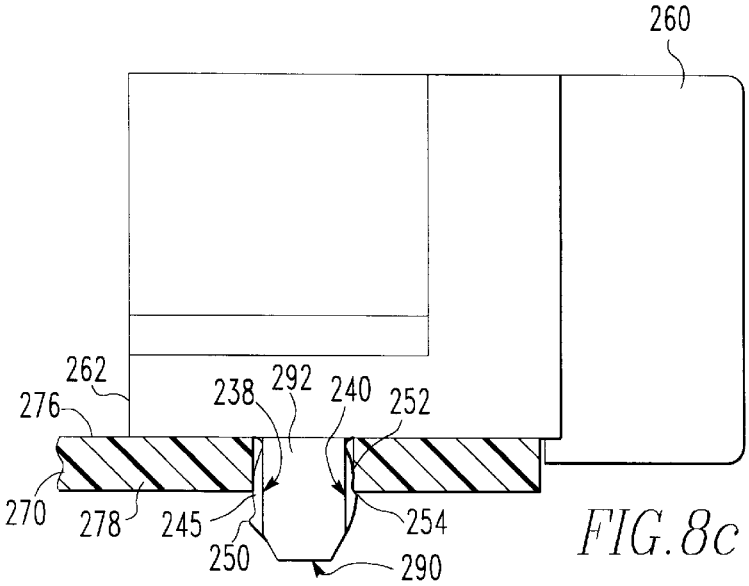
FIG. 8*c* is a side elevational view of the assembly shown in FIG. 8*b* after the receptacle and boardlock are engaged with the PCB.

Referring particularly to FIGS. 8*a*–8*c*, the engagement of the boardlock to the board as would be seen from the side is illustrated. As will be seen from FIGS. 8*a* and 8*b*, the lead in device 290 assists in aligning the receptacle with the aperture 272. When this alignment is accomplished, downward pressure is applied to the receptacle to engage the lead in device along with the boardlock with the PCB 270. PCB 270 may, for example, have a thickness of 0.062 in. From FIG. 8*c* it will be seen that when the mounting foot 262 is superimposed on the top surface 276 of the PCB the arcuate edges of the legs 248 and 252 will bear against the peripheral surface 274 of the aperture. At this point the projection 254 from the arcuate edge 252 will bear against the bottom surface 278 of the PCB. The projection 250 which is spaced axially downwardly from projection 254 will not be engaged by the board 270. Referring, however, to FIGS. 9*a* and 9*b* the use of this assembly is shown in engaging a connector to a thicker PCB to a connector. Referring particularly to FIG. 9*a*, the operation of the assembly from its front is shown. As downward pressure is applied to the receptacle 260, the mounting foot approaches the top surface 286 of the PCB 280, the semi cylindrical members guide the boardlock toward the aperture 282. Referring particularly to FIG. 9*b* when the PCB is at rest on this surface, the protection 250 bears against the bottom surface 288 of the PCB. Thus it is again illustrated that a single boardlock will serve to fix a receptacle on two boards of different thicknesses.

It will be appreciated that a means for efficiently and inexpensively mounting an electrical connector on a PCB has been described in which a single boardlock may be used on several board thicknesses.

Those skilled in the art will also appreciate that although the embodiments illustrated included only one PCB engaging projection on each leg that it would be possible to have several axially spaced projections on each leg to adapt the device to engage more than two board thicknesses.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An assembly comprising:

(a) a first printed circuit board (PCB) having a top surface and a bottom surface and a mounting aperture extending between said top surface and said bottom surface;

(b) a component of an electrical connector having a mounting foot with a mounting aperture; and (c) a conductive metallic boardlock member extending axially through said aligned mounting apertures in said PCB and said mounting foot and having a mounting foot engagement means from where opposed first and second resilient legs depend from said mounting foot engagement means and said first leg has a first outer arcuate edge and a first projection extends outwardly from said first outer arcuate edge and said second leg has a second outer arcuate edge and a second projection extends outwardly from said second outer arcuate edge and said first and second projections are axially displaced from one another and wherein said first projection abuts against the bottom surface of the first PCB and said second projection is adapted to abut against a bottom surface of a second PCB which is different in thickness from said first PCB and the first and second legs have opposed lateral sides and legs are interposed in spaced relation between opposed semi cylindrical members and the first and second printed circuit board engagement means extend outwardly from said semi cylindrical members.

* * * * *